US009236030B2

(12) United States Patent
Kitazawa et al.

(10) Patent No.: US 9,236,030 B2
(45) Date of Patent: Jan. 12, 2016

(54) ELECTRO-OPTIC DEVICE AND ELECTRONIC DEVICE

(71) Applicant: SEIKO EPSON CORPORATION, Tokyo (JP)

(72) Inventors: Takayuki Kitazawa, Suwa (JP); Kazuma Kitadani, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 142 days.

(21) Appl. No.: 14/169,990

(22) Filed: Jan. 31, 2014

(65) Prior Publication Data

US 2014/0232708 A1 Aug. 21, 2014

(30) Foreign Application Priority Data

Feb. 15, 2013 (JP) ..... 2013-027615

(51) Int. Cl.
*G09G 5/10* (2006.01)
*G09G 3/32* (2006.01)

(52) U.S. Cl.
CPC ..... *G09G 5/10* (2013.01); *G09G 3/3233* (2013.01); *G09G 2300/0861* (2013.01); *G09G 2320/041* (2013.01); *G09G 2320/0626* (2013.01)

(58) Field of Classification Search
None
See application file for complete search history.

(56) References Cited

U.S. PATENT DOCUMENTS

| | | | | |
|---|---|---|---|---|
| 2007/0080905 | A1 * | 4/2007 | Takahara | 345/76 |
| 2007/0210722 | A1 * | 9/2007 | Konno et al. | 315/185 S |
| 2009/0079727 | A1 | 3/2009 | Ozawa | |
| 2010/0194675 | A1 * | 8/2010 | Yoshida et al. | 345/102 |
| 2013/0083228 | A1 * | 4/2013 | Iwatani | 348/333.01 |

FOREIGN PATENT DOCUMENTS

| | | |
|---|---|---|
| JP | A-2007-101826 | 4/2007 |
| JP | A-2008-191611 | 8/2008 |
| JP | A-2009-80252 | 4/2009 |
| JP | A-2010-164602 | 7/2010 |
| JP | A-2011-221127 | 11/2011 |
| JP | B1-4976604 | 7/2012 |
| JP | B1-4997346 | 8/2012 |
| WO | WO 2012001749 A1 * | 1/2012 |

* cited by examiner

*Primary Examiner* — Kent Chang
*Assistant Examiner* — Nathan Brittingham
(74) *Attorney, Agent, or Firm* — Oliff PLC

(57) ABSTRACT

An electro-optic device including a pixel circuit that includes an electro-optic element and a driving transistor; a first data generation unit that, during a first period when image display operation is not performed, detects a temperature and generates first data which allows control of brightness of an image in accordance with the detected temperature; and a luminance control unit that, during a second period when image display operation is performed, performs control of luminance of the electro-optic element on the basis of the first data which is generated during the first period.

11 Claims, 8 Drawing Sheets

ELECTRO-OPTIC DEVICE AND ELECTRONIC DEVICE

BACKGROUND

1. Technical Field

The present invention relates to a technology for controlling electro-optic elements for use in an electro-optic device or the like.

2. Related Art

Recently, display devices, each employing electro-optic elements, such as organic EL elements, which emit light with a luminance level in accordance with an amount of electric current flowing therethrough, have been in practical use. Such a display device, generally, uses pixel circuits each controlling an electric current supplied to the electro-optic element in accordance with an electric potential of the gate of a transistor (hereinafter, referred to as a "driving transistor"). The electric-current characteristic of the driving transistor varies depending on temperature. Thus, a variation of temperature results in a variation of the brightness of displayed images. In this regard, in JP-A-2011-221127, there has been disclosed a technology for detecting a temperature and correcting the luminance of electro-optic element on the basis of the detected temperature.

In conventional temperature correction methods, nevertheless, a correction for temperature has been made on the basis of a detected temperature on a real time basis. Thus, any correction error immediately results in a variation of the luminance of currently displayed images. In particular, in the case where the pixel circuit is formed on a silicon substrate, a sub-threshold region of the driving transistor is sometimes used as an operation area of the driving transistor. Since, in the sub-threshold region of the driving transistor, the electric-current characteristic thereof sensitively and largely varies, any real time process of measuring a temperature and controlling the luminance of a currently displayed image based on the measured temperature causes frequent and large variations of the luminance of the currently displayed image. Thus, there has been a problem that this frequent and large variations of the luminance of an image on a display screen result in the occurrence of flickering of the image.

SUMMARY

An electro-optic device according to a first aspect of the invention includes a pixel circuit that includes an electro-optic element and a driving transistor which supplies an electric current to the electro-optic element; a first data generation unit that, during a first period when image display operation is not performed, detects a temperature and generates first data which allows control of brightness of an image in accordance with the detected temperature; and a luminance control unit that, during a second period when image display operation is performed, performs control of luminance of the electro-optic element on the basis of the first data which is generated during the first period.

According to this first aspect of the invention, the first data is generated on the basis of a temperature which is measured during the first period when image display operation is not performed, and the luminance of the electro-optic element is controlled during the second period when image display operation is performed on the basis of the first data. That is, during a period when image display operation is performed, the luminance of the electro-optic element is controlled on the basis of a temperature measured during a period through which image display operation is not performed and which is immediately anterior to the period when image display operation is performed, and thus, even when temperature varies while an image is displayed, the brightness of the image is not allowed to vary, so that it is possible to suppress the occurrence of flickering of the image.

In the aforementioned electro-optic device according to the first aspect of the invention, preferably, the pixel circuit, the first data generation unit and the luminance control unit are formed on a single-crystalline silicon substrate. When a driving transistor for controlling an electric current supplied to the electro-optic element is formed on a silicon substrate, an operation region of the driving transistor results in use of a sub-threshold region thereof. In the sub-threshold region, the electric-current characteristic of the driving transistor varies depending on temperature to a great degree. Thus, when, during a period when an image is displayed, a temperature is measured and control of the luminance of the electro-optic element is performed on the basis of the measured temperature, the flickering of the image occurs. In this regard, however, according to the first aspect of the invention, the luminance of the electro-optic element during the period when image display operation is performed is controlled on the basis of a temperature which is measured during the period when image display operation is not performed, and thus, it is possible to, during the period when image display operation is performed, suppress the occurrence of flickering of an image on a display screen.

In the aforementioned electro-optic device according to the first aspect of the invention, preferably, the first data generation unit includes a temperature detection unit which detects the temperature, and an average temperature calculation unit which calculates an average value of temperatures obtained by causing the temperature detection unit to perform the detection a plurality of times, and generates the first data on the basis of the average value. In the case where the temperature detection unit and the luminance control unit are formed on a single-crystalline silicon substrate, noise arising in the luminance control unit is likely to give an adverse influence on the temperature detection unit, and make it difficult to detect the temperature with accuracy. In this regard, however, according to the configuration described above, the provision of the average temperature calculation unit makes it possible to suppress the influence of the noise.

More specifically, preferably, the temperature detection unit includes a temperature detection circuit that outputs, for each of the plurality of detections, a temperature signal indicating a voltage equivalent to a temperature; a counter that counts, for each of the plurality of detections, a horizontal synchronization signal and outputs resultant count data; and a DA conversion circuit that, for each of the plurality of detections, performs DA conversion of the count data and outputs a resultant count signal. Further, preferably, the temperature detection unit outputs, for each of the plurality of detections, the count data at timing when the temperature signal and the count signal coincide with each other, as one of pieces of temperature data which indicates the temperature, and further, preferably, the average value calculation unit calculates an average value of the plurality of pieces of temperature data.

In the aforementioned electro-optic device according to the first aspect of the invention, preferably, the first data specifies, for each of vertical synchronization periods, a light emitting period during which the electric current is supplied to the electro-optic element. In this case, the supply of an electric current to the electro-optic element during the light emitting period which is specified by the first data makes it possible to correct the variation of luminance of the electro-optic element due to the variation of temperature.

In the aforementioned electro-optic device according to the first aspect of the invention, preferably, the first data generation unit starts the detection of temperature from at least one timing point of a transition from the second period to the first period. In this case, it becomes possible to perform the detection of a temperature without any delay prior to start of a next second period. In addition, the first data generation unit is preferable to also start the detection of temperature at timing of the completion of an initialization process.

In the aforementioned electro-optic device according to the first aspect of the invention, preferably, the first data generation unit periodically generates the piece of first data during the first period, and the luminance control unit performs control of the luminance of the electro-optic element on the basis of the piece of first data which is generated last during the first period.

In the case where the length of the first period is long, the temperature varies during the first period to a certain degree. In this regard, however, according to the configuration described above, in the case where the plurality of pieces of first data is generated during the first period, the luminance of the electro-optic element is controlled on a last one of the plurality of pieces of first data, and thus, it becomes possible to correct temperature with further accuracy.

An electronic device according to a second aspect of the invention includes the electro-optic device according to the first aspect of the invention; and a control unit that supplies the electro-optic device with a lighting control signal which specifies any one of the first period and the second period.

More specifically, preferably, the electronic device includes a viewfinder that includes the electro-optic device and a detection unit which detects an event when a user looks in the viewfinder, and the control unit generates the lighting control signal on the basis of a result of detection made by the detection unit, and supplies the generated lighting control signal to the electro-optic device. Such an electronic device corresponds to a digital still camera, a video camera or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A: Embodiment

Figure 1:
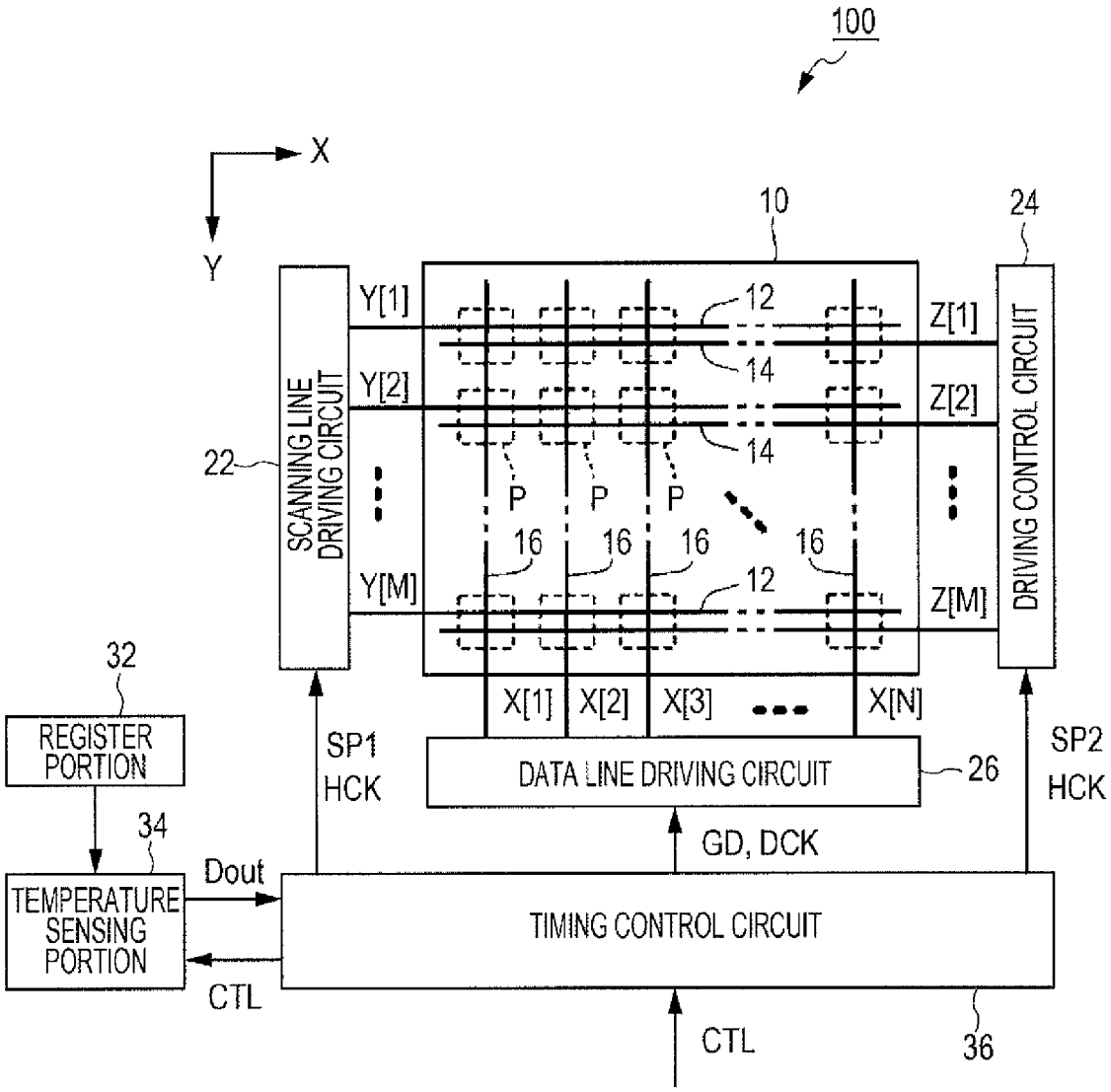
FIG. 1 is a block diagram illustrating a configuration of an electro-optic device according to an embodiment of the invention.

FIG. 1 is a block diagram illustrating a configuration of an electro-optic device (a display device) according to an embodiment of the invention. As shown in FIG. 1, an electro-optic device 100 includes an element array portion 10 in which a plurality of pixel circuits P is arranged, a scanning line driving circuit 22, a driving control circuit 24, a data line driving circuit 26, a register portion 32 which stores therein various pieces of setting data, a temperature sensing portion 34 which detects temperatures and specifies a period during which electro-optic elements emit light. These constitutive elements are preferred to be formed on a single-crystalline silicon substrate. Further, the electro-optic device 100 is controlled by a lighting control signal CTL supplied from an external device with respect to whether image display operation is to be performed or not to be performed. Further, during a first period when image display operation is not to be performed, the electro-optic device 100 measures temperatures, and during a second period when image display operation is to be performed, the electro-optic device 100 displays an image whose luminance has been corrected on the basis of the measured temperatures.

In the element array portion 10, there are formed M scanning lines 12 extending in an X direction; M driving control lines 14 each forming a pair with one of the scanning lines 12 and extending in the X direction; and N data lines 16 extending in a Y direction intersecting with the X direction (M and N each being a natural number larger than or equal to two). The pixel circuits P are each arranged so as to correspond to one of the intersections of the scanning lines 12 and the data lines 16. Thus, in the whole of the element array portion 10, the pixel circuits P are arranged in a matrix of M vertical rows and N horizontal columns across the X direction and the Y direction.

Figure 2:
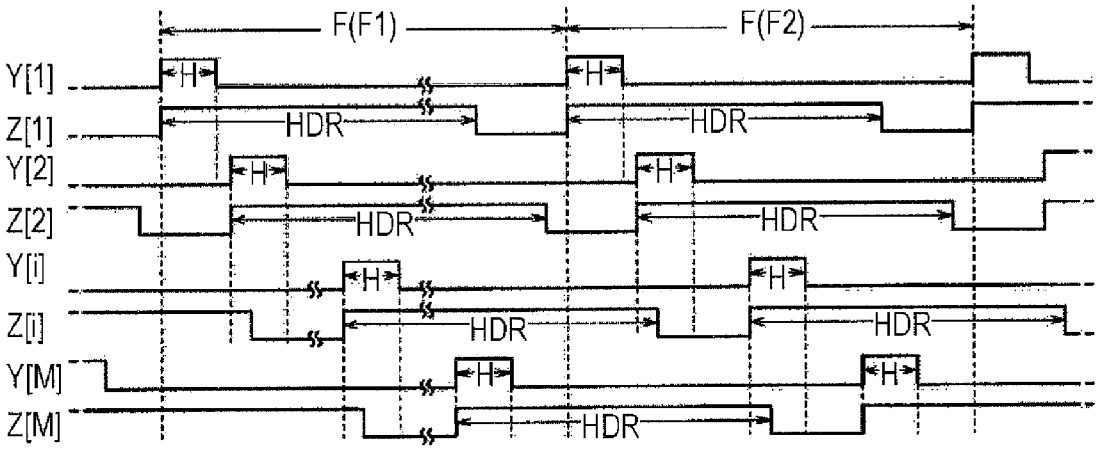
FIG. 2 is a time chart illustrating waveforms of individual portions of an electro-optic device according to an embodiment of the invention.

The scanning line driving circuit 22 is a means that generates scanning signals Y [1] to Y [M] each sequentially selecting a corresponding one of the M scanning lines 12 (i.e., pixel circuits P belonging to a corresponding one of the rows) and outputs each of the scanning signals Y [1] to Y [M] to a corresponding one of the scanning lines 12, and that is constituted by, for example, a shift register of M bits. As shown in FIG. 2, a scanning signal Y [i] supplied to a scanning line 12 of an i-th row (i being one of natural numbers from 1 to M) becomes high (H)-level during an i-th writing period (an i-th horizontal scanning period) H within a frame period F (F1, F2, . . . ), and is kept to low (L)-level during a period except the writing period H. The scanning line driving circuit 22 generates each of the scanning signals Y [1] to Y [M] by sequentially sifting a start pulse SP1 which becomes H-level during a period whose length is equivalent to that of one of the horizontal scanning periods, while using a clock signal HCK synchronized with horizontal synchronization signal SYNC. The start pulse SP1 and the clock signal HCK are supplied from a timing control circuit 36.

The driving control circuit 24 shown in FIG. 1 generates driving control signals Z [1] to Z [M] and outputs each of these to a corresponding one of the driving control lines 14. As shown in FIG. 2, a driving control signal Z [i] supplied to a driving control line 14 of an i-th row is kept to H-level during a period HDR having a given period from a start point of the writing period H, at which the scanning signal Y [i] becomes H-level, until a point after elapse of the writing period H (the point being positioned before a start point of a next writing period H), and becomes L-level during a period except the period HDR. Hereinafter, this period HDR will be referred to as "a light emitting period HDR".

The driving control circuit 24 generates each of the driving control signals Z [1] to Z [M] by shifting a start pulse SP2 which becomes H-level during a period whose length is equivalent to that of the light emitting period HDR, while using the clock signal HCK. The start pulse SP2 and the clock signal are supplied from the timing control circuit 36.

The data line driving circuit 26 shown FIG. 1 generates data signals X [1] to X [N] on the basis of pieces of grayscale data GD each specifying a grayscale level of a corresponding one of the pixel circuits P, and outputs each of the generated data signals X [1] to X [N] to a corresponding one of the data lines 16. A data signal X [j] (j being one of natural numbers from 1 to N) becomes an electric potential VDATA equivalent to one of the pieces of grayscale data GD which is associated with a corresponding one of the pixel circuits P which belongs to an i-th row and is of a j-th column. The data line driving circuit 26 is supplied with the pieces of grayscale data GD, a dot clock signal DCK and the clock signal HCK from the timing control circuit 36.

The timing control circuit 36 generates various control signals, and supplies the generated control signals to the scanning line driving circuit 22, the driving control circuit 24, the data line driving circuit 26 and the temperature sensing portion 34. Further, the timing control circuit 36 causes the scanning line driving circuit 22, the driving control circuit 24 and the data line driving circuit 26 to operate during the second period when image display operation is performed, and causes the scanning line driving circuit 22, the driving control circuit 24 and the data line driving circuit 26 not to operate during the first period when image display operation is not performed, in accordance with the lighting control signal CTL supplied from an external device. Specifically, during the first period, the timing control circuit 36 causes each of the signals supplied to the scanning line driving circuit 22, the driving control circuit 24 and the data line driving circuit 26 to be in an inactive state. Through this operation, in these driving circuits, any transfer operation which is synchronized with the clock signal HCK and the dot clock signal DCK and is performed in order to drive the pixel circuits P is not carried out. As a result, the level of noise occurring in the driving circuits is reduced during the first period.

Meanwhile, the timing control circuit 36 supplies the lighting control signal CTL, the horizontal synchronization signal HSYNC, a vertical synchronization signal VSYNC and a reset signal RES to the temperature sensing portion 34. The temperature sensing portion 34 measures temperatures during the first period when the lighting control signal CTL causes image display operation not to be performed, and generates a piece of output data Dout which specifies the length of the light emitting period HDR of the electro-optic elements E. More specifically, the piece of output data Dout specifies a total number of lines equivalent to a period of time during which the electro-optic elements are caused to emit light. The piece of output data Dout is generated and outputted during the first period, and is also continued to be outputted during the second period. The timing control circuit 36 determines the length of a period during which the start pulse SP2 becomes H-level, which is outputted to the driving control circuit 24 during the second period, on the basis of the piece of output data Dout. In this way, the length a period during which each of the driving control signals Z [1] to Z [M] becomes H-level is determined in accordance with the piece of output data Dout.

The luminance of the electro-optic elements E is determined in accordance with the length of the light emitting period HDR. Thus, it becomes possible to correct the luminance of the electro-optic elements E during the second period on the basis of temperatures which are measured during the first period by the temperature sensing portion 34. Moreover, the piece of output data Dout is not changed during the second period when image display operation is performed, and thus, it is possible to prevent the occurrence of a problem that a large variation of the length of the light emitting period HDR causes the flickering of images during the second period.

Next, a specific configuration of each of the pixel circuits P will be described with reference to FIG. 3. In addition, in FIG. 3, only one of the pixel circuits P, which belongs to an i-th and is of a j-th column, is illustrated as a representative thereof.

Figure 3:
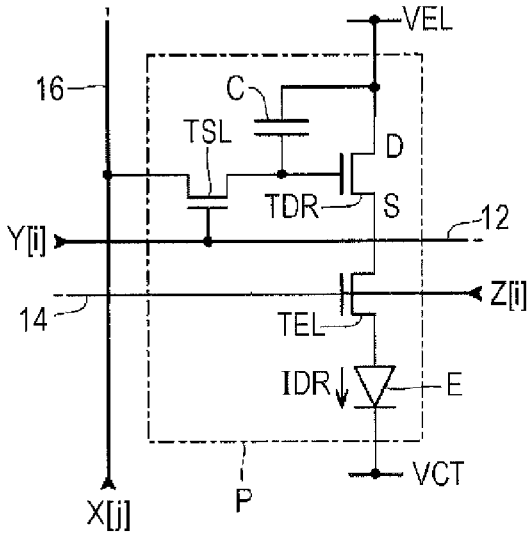
FIG. 3 is a circuit diagram illustrating an example of a pixel circuit used in an electro-optic device according to an embodiment of the invention.

As shown in FIG. 3, the pixel circuit P includes one of the electro-optic elements E. The electro-optic element E of this embodiment is an organic light emitting diode including a light emitting layer, which is composed of an organic electroluminescence (EL) material, interposed between a positive electrode and a negative electrode which face to each other. The electro-optic element E emits light with an intensity equivalent to an electric current amount of a driving electric current IDR which is supplied to the light emitting layer. The negative electrode of the electric-optic element E is electrically connected to a lower electric-potential power supply (having a ground potential) VCT.

An N-channel type driving transistor TDR is arranged on the path via which the driving electric current IDR flows (i.e., between a higher electric-potential power supply VEL and the electro-optic element E). The driving transistor TDR is a means which performs control of an electric current amount of the driving electric current IDR in accordance with a voltage between the gate and the source thereof. The drain (D) of the driving transistor TDR is electrically connected to the higher electric-potential power supply VEL.

A capacitor element C is arranged between the gate of the driving transistor TDR and the drain thereof (i.e., the higher power supply voltage VEL). Further, an N-channel type selection transistor TSL is arranged between the gate of the driving transistor TDR and one of the data lines 16. The selection transistor TSL is a switching element for controlling an electric connection (i.e., a conductive connection and a non-conductive connection) between the gate of the driving transistor TDR and one of the data lines 16. The scanning line 12 of an i-th row is commonly electrically connected to the gate of the selection transistor TSL of each pixel circuit P belonging to the i-th row.

An N-channel type driving control transistor TEL is arranged between the source (8) of the driving transistor TDR and the positive electrode of the electro-optic element E (i.e., on the path via which the driving current IDR flows). This driving control transistor TEL is a switching element for controlling an electric connection between the source of the driving transistor TDR and the positive electrode of the electro-optic element E. The path via which the driving electric current IDR flows is established by causing the driving control transistor TEL to be in a conductive state, and thus, the driving control transistor TEL functions as a means for performing control as to whether or not the driving electric current IDR is to be supplied to the electro-optic element E. The driving control line 14 of an i-th row is commonly electrically connected to the gate of the driving control transistor TEL of each pixel circuit P belonging to the i-th row.

In the above-described configuration, as shown in FIG. 2, when a scanning signal Y [i] transits to H-level during a writing period H (that is, when a scanning line 12 of an i-th row is selected), the selection transistor TSL is caused to be in a conductive state. Thus, when the scanning signal Y [i] transits to H-level during the writing period H, an electric potential VDATA of a data signal X [i] is supplied to the gate of the driving transistor TDR via the selection transistor TSL, and simultaneously therewith, electric charges equivalent to the electric potential VDATA are stored in the capacitor element C. That is, a gate electric potential VG of the driving transistor TDR is set to an electric potential VDATA equivalent to one of the pieces of grayscale data GD.

When the scanning line Y [i] transits to L-level at the end point of the writing period H, the selection transistor TSL is caused in a non-conductive state and the gate of the driving transistor TDR is electrically isolated form the data line 16. Nevertheless, even after elapse of the writing period H, the electric potential VG of the driving transistor TDR is kept to the electric potential VDATA by the capacitor element C.

Meanwhile, the driving control transistor TEL is caused in a conductive state from the start point of the writing period H at which the driving control signal Z [i] transits to H-level. Thus, during the light emitting period HDR including the writing period H, the driving current IDR having an electric current amount equivalent to an electric potential VG of the gate of the driving transistor TDR (the electric potential VG being equal to an electric potential VDATA) is supplied from the higher electric-potential power supply VEL to the electro-optic element E via the driving control transistor TDR. The electro-optic element E emits light with an intensity equivalent to the electric current amount of the driving electric current IDR (that is, an intensity equivalent to the electric potential VDATA).

In this embodiment, the length of the light emitting period HDR is controlled in accordance with temperature. Specifically, the length of the light emitting period HDR becomes shorter as temperature becomes higher. This is because, when temperature becomes high, even when the gate electric potential VG is kept constant, the amount of the electric current IDR supplied to the electro-optic element E by the driving transistor TDR becomes large, and thereby, the luminance of the electro-optic element E becomes high.

Figure 4:
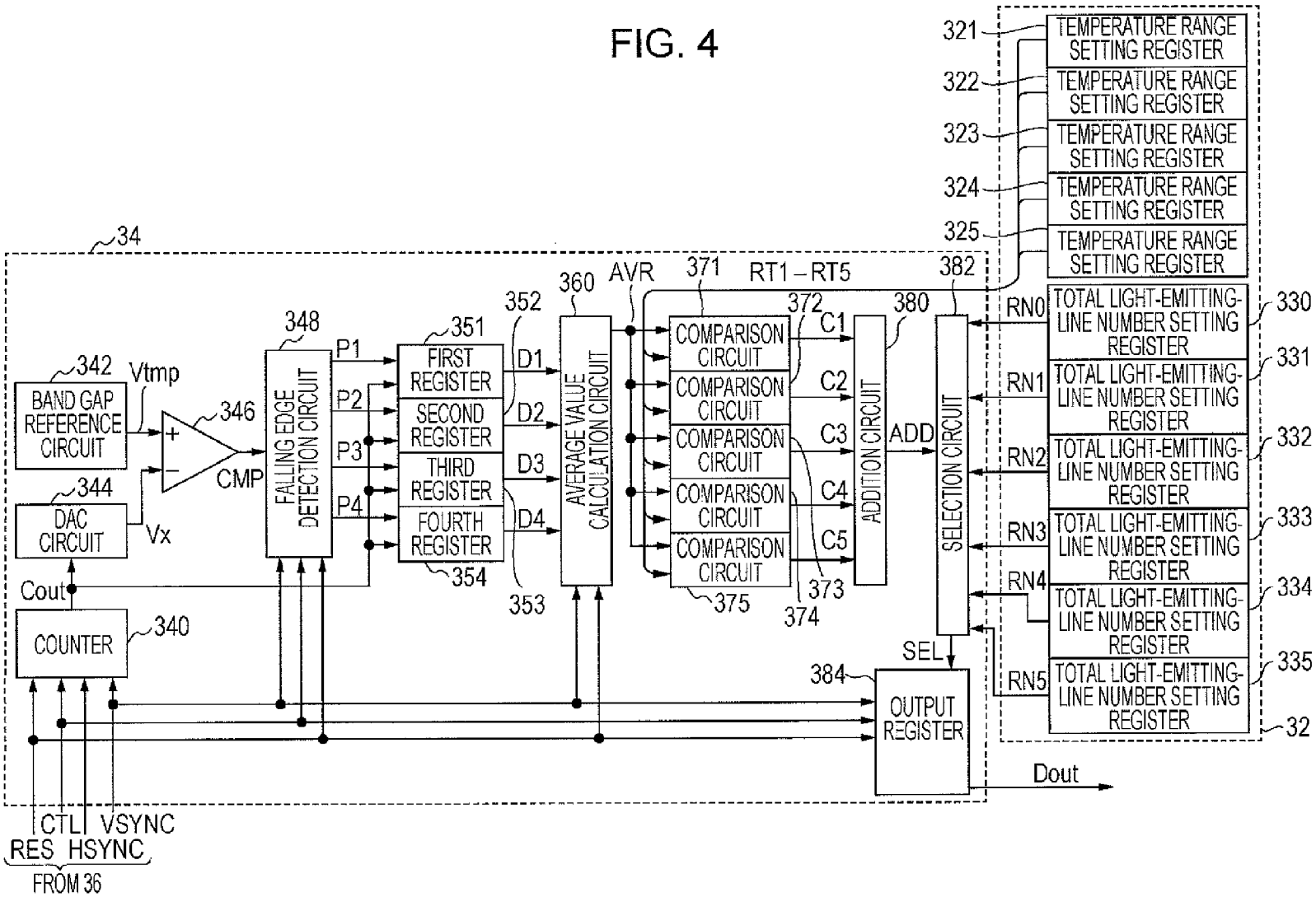
FIG. 4 is a block diagram illustrating a configuration of a temperature sensing portion and a register portion used in an electro-optic device according to an embodiment of the invention.

Next, in FIG. 4, a block diagram of the register portion 32 and the temperature sensing portion 34 is illustrated. The register portion 32 includes temperature range setting range registers 321 to 325 and total light-emitting-line number setting registers 330 to 335. These registers are each constituted by a nonvolatile memory. The temperature range setting registers 321, 322, 323, 324 and 325 store therein pieces of temperature range setting data RT1, RT2, RT3, RT4 and RT5, respectively. The pieces of temperature setting range data RT1 to RT5 of this example are each composed of seven bits of data. Temperature sensing portion 34 carries out the measurement of temperature. The pieces of temperature range setting data RT1 to RT5 each indicate a threshold value used for determination as to which one of temperature ranges the result of the temperature measurement belongs to. In this example, the piece of temperature range setting data RT1 is "20"; the piece of temperature range setting data RT2 is "35"; the piece of temperature range setting data RT3 is "50"; the piece of temperature range setting data RT4 is "65"; and the piece of temperature range setting data RT5 is "80".

The total light-emitting-line number setting registers 330, 331, 332, 333, 334 and 335 store therein pieces of total light-emitting-line setting data RN0, RN1, RN2, RN3, RN4 to RN5, respectively. The temperature sensing portion 34 generates the piece of output data Dout, which specifies, for each of the horizontal scanning periods, the length of the light emitting period HDR, in accordance with the result of the determination as to which one of the temperature ranges the result of the temperature measurement belongs to. The pieces of total light-emitting-line number setting data RN0 to RN5 each indicate a total light-emitting-line number. In this example, the piece of total light-emitting-line number setting data RN0 is "250"; the piece of total light-emitting-line number setting data RN1 is "240"; the piece of total light-emitting-line number setting data RN2 is "230"; the piece of total light-emitting-line number setting data RN3 is "220"; the piece of total light-emitting-line number setting data RN4 is "200"; and the piece of total light-emitting-line number setting data RN5 is "180".

The temperature sensing portion 34 includes a counter 340 that counts a falling edge or a rising edge of the horizontal synchronization signal HSYNC and outputs a piece of count data Cout; a band cap reference circuit 342 that outputs a temperature signal Vtmp indicating a voltage equivalent to a measured temperature; a DAC circuit 344 that performs DA conversion of the piece of count data Cout and outputs a resultant count signal Vx; and a comparator 346 provided with a positive input terminal to which the temperature signal Vtmp is supplied and a negative input terminal to which the count signal Vx is supplied.

The counter 340 is supplied with the reset signal RES, the lighting control signal CTL, the horizontal synchronization signal HSYNC and the vertical synchronization signal VSYNC from the timing control circuit 36. The reset signal RES is a signal which transits from L-level to H-level when the power of the electro-optical device 100 is turned on and the electro-optical device 100 transits from a non-operation state to an operation state. The timing control circuit 36 carries out an initialization operation, being synchronized with the rising of the reset signal RES. The lighting control signal CTL specifies the second period when image display operation is performed in the electro-optic device 100, and becomes H-level during the second period and becomes L-level during the first period when image display operation is not performed. In addition, the reset signal RES and the lighting control signal CTL are also supplied to, besides the counter 340, an average value calculation circuit 360 and an output register 384 both of which will be described below. The counter 340, the average value calculation circuit 360 and the output register 384 are initialized at each of timing points, one being the rising of the reset signal RES, the other one being the falling of the lighting control signal CTL.

The counter 340 carries out counting during a period when the reset signal RES is in the H-level state and further the lighting control signal CTL is in the L-level state. In addition, for a period immediately after the reset signal RES transits from L-level to H-level, the counter 340 starts counting at timing when the vertical synchronization signal VSYNC initially becomes active (L-level). Further, even though the reset signal RES is in the H-level state, the counter 340 does not carry out counting during the second period when the lighting control signal CTL becomes H-level and image display operation is performed.

The comparator 346 generates an output signal CMP of H-level when the level of the counter signal Vx is smaller than or equal to that of the temperature signal Vtmp, and generates an output signal CMP of L-level when the level of the counter signal Vx is larger than that of the temperature signal Vtmp. Thus, a digital value of the piece of count data Cout at timing when the output signal CMP falls from H-level to L-level is equivalent to a digital value resulting from performing AD conversion of a measured temperature.

Figure 5:
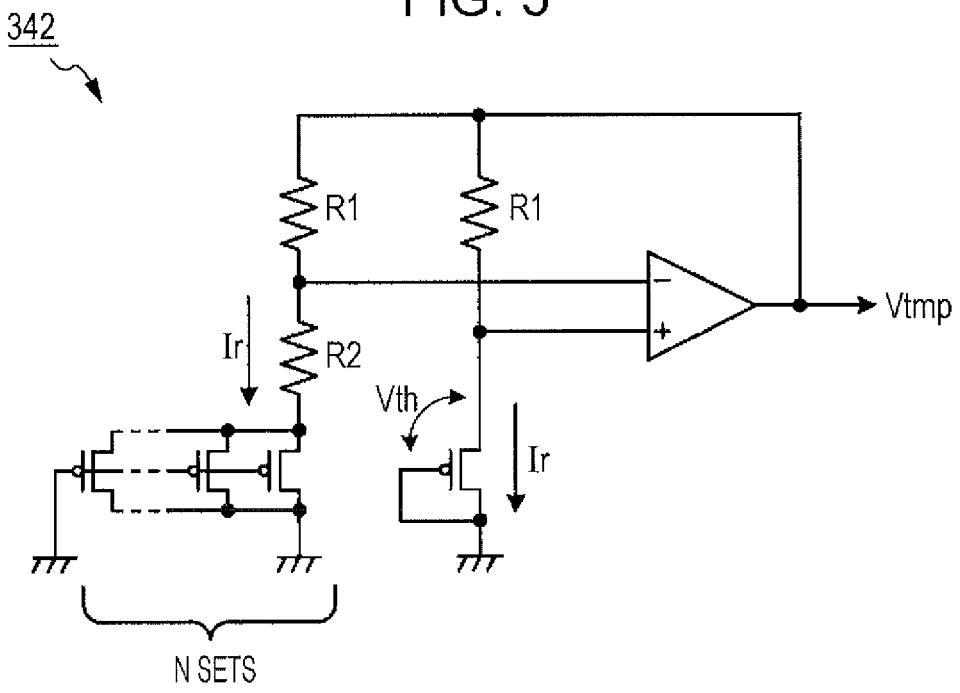
FIG. 5 is a circuit diagram illustrating a configuration of a band gap preference circuit used in an electro-optic device according to an embodiment of the invention.

In FIG. 5, a detailed configuration of the band gap reference circuit 342 is illustrated. The band gap reference circuit 342 is preferable to be provided adjacent to the element array portion 10 so as to allow the band gap reference circuit 342 to measure the temperature of the driving transistor TDR as accurately as possible. In addition, as a substitute for the band gap reference circuit 342 exemplified in FIG. 5, naturally, a different circuit capable of outputting the temperature signal Vtmp indicating a voltage equivalent to a measured temperature may be employed. In the band gap reference circuit 342 shown in FIG. 5, the temperature signal Vtmp is given by the following formula:

$$Vtmp=Vth+(KT/q)(R1\cdot\ln N/R2)$$

In addition, K is Boltzmann constant ($=1.381*10^{-23}$ [$m^2\cdot kg/s^2\cdot K$]); T is absolute temperature; and q is elementary charge ($=1.602*10^{-19}$ [C]).

Figure 6:
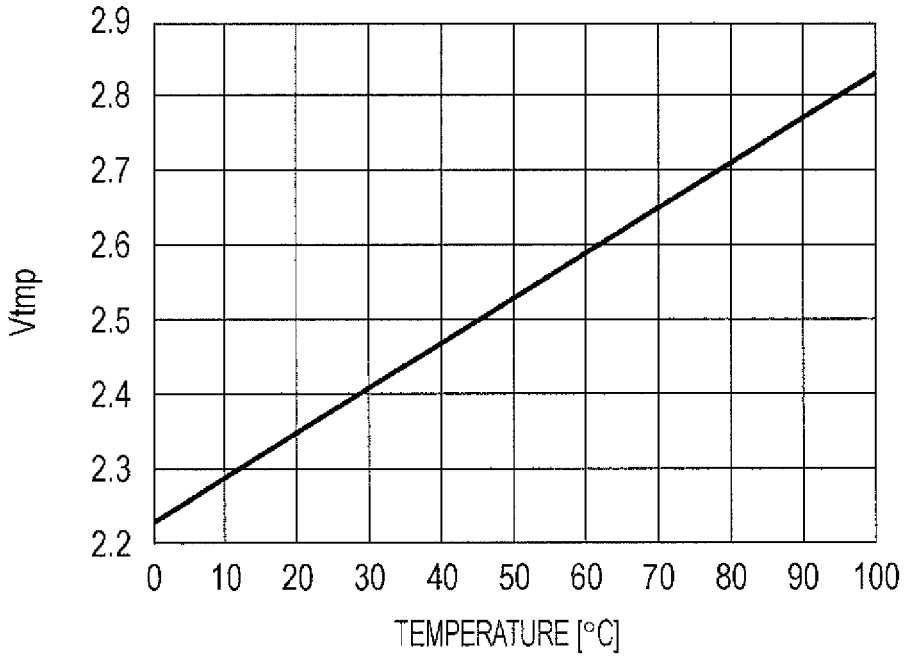
FIG. 6 is a graph illustrating an example of the characteristic of a band gap preference circuit used in an electro-optic device according to an embodiment of the invention.

For example, as shown in FIG. 6, in the case where R1 is 1 MΩ, and R2 is 10 KΩ, the temperature signal Vtmp becomes larger as temperature becomes higher.

Here, the description is returned to FIG. 4. The temperature sensing portion 34 includes a falling edge detection circuit 348 and first to fourth registers 351 to 354. The falling edge detection circuit 348 detects a falling edge of the output signal CMP outputted from the comparator 346 four times through a series of detection operations. A detection pulse P1 is supplied to the first register 351 in a first detection; a detection pulse P2 is supplied to the second register 352 in a second detection; a detection pulse P3 is supplied to the third register 353 in a third detection; and a detection pulse P4 is supplied to the fourth register 354 in a fourth detection. Each of the first to fourth registers 351 to 354 latches the piece of count data Cout, being synchronized with a corresponding one of the detection pulses P1 to P4, and outputs a corresponding one of pieces of temperature data D1 to D4.

Here, the operation of the falling edge detection circuit 348 is reset immediately after a rising edge of the reset signal RES from L-level to H-level or immediately after a falling edge of the lighting control signal CTL from H-level to L-level. Subsequently, the falling edge detection circuit 348 generates each of the detection pulses P1 to P4, being synchronized with a corresponding one of the falling edges of the output signal CMP outputted from the comparator 346. As a result, each of the pieces of temperature data D1 to D4 is stored into a corresponding one of the first to fourth registers 351 to 354, being synchronized with a corresponding one of the falling edges of the output signal CMP outputted from the comparator 346.

The temperature sensing portion 34 further includes an average value calculation circuit 360, comparison circuits 371 to 375, an addition circuit 380, a selection circuit 382 and an output register 384. The average value calculation circuit 360 outputs a piece of average temperature data AVR resulting from averaging the pieces of temperature data D1 to D4, being synchronized with a falling edge of the vertical synchronization signal VSYNC. The comparison circuits 371, 372, 373, 374 and 375 are supplied with the pieces of temperature range setting data RT1, RT2, RT3, RT4 and RT5, respectively. The comparison circuits 371, 372, 373, 374 and 375 compares the pieces of temperature range setting data RT1, RT2, RT3, RT4 and RT5 with the piece of average temperature data AVR, and outputs pieces of comparison result data C1, C2, C3, C4 and C5, respectively, so that each of the pieces of comparison result data C1 to C5 becomes "1" in the case where a corresponding one of the pieces of temperature range setting data RT1 to RT5 is larger than or equal to the piece of average temperature data AVR, and becomes "0" in the case where the corresponding one of the pieces of temperature range setting data RT1 to RT5 is smaller than the piece of average temperature data AVR. The addition circuit 380 performs addition of the pieces of comparison result data C1 to C5, and outputs a piece of addition data ADD.

The selection circuit 382 is supplied with the pieces of total light-emitting-line number setting data RN0 to RN5. The selection circuit 382 selects and outputs, as a piece of selection data SEL, one of the pieces of total light-emitting-line number setting data RN0 to RN5 on the basis of the piece of addition data ADD. In this example, the piece of total light-emitting-line number setting data RN5 is selected in the case where the piece of addition data ADD is "5"; the piece of total light-emitting-line number setting data RN4 is selected in the case where the piece of addition data ADD is "4"; the piece of total light-emitting-line number setting data RN3 is selected in the case where the piece of addition data ADD is "3"; the piece of total light-emitting-line number setting data RN2 is selected in the case where the piece of addition data ADD is "2", the piece of total light-emitting-line number setting data RN1 is selected in the case where the piece of addition data ADD is "1"; and the piece of total light-emitting-line number setting data RN0 is selected in the case where the piece of addition data ADD is "0".

The output register 384 resets the value of the piece of output data Dout to "0" upon detection of each of a rising edge of the reset signal RES and a falling edge of the lighting control signal CTL, so as to prevent output of an unexpected total light-emitting-line number. Further, the output register 384 reads in the piece of selection data SEL, being synchronized with a second falling edge of the vertical synchronization signal VSYNC after the reset of the value of the piece of output data Dout, and outputs the read-in piece of selection data SEL as the piece of output data Dout.

As described above, during the first period when image display operation is not performed, the temperature sensing portion 34 measures temperatures, calculates the piece of average temperature data AVR indicating an average value of the measured temperatures, and generates the piece of output data Dout specifying a total light-emitting-line number on the basis of the calculated piece of average temperature data AVR.

Next, operation of the electro-optic device 100 will be described by dividing the operation thereof into operation during a period immediately after the power-on of the electro-optic device 100, and operation during a period when image display operation is not performed.

Figure 7:
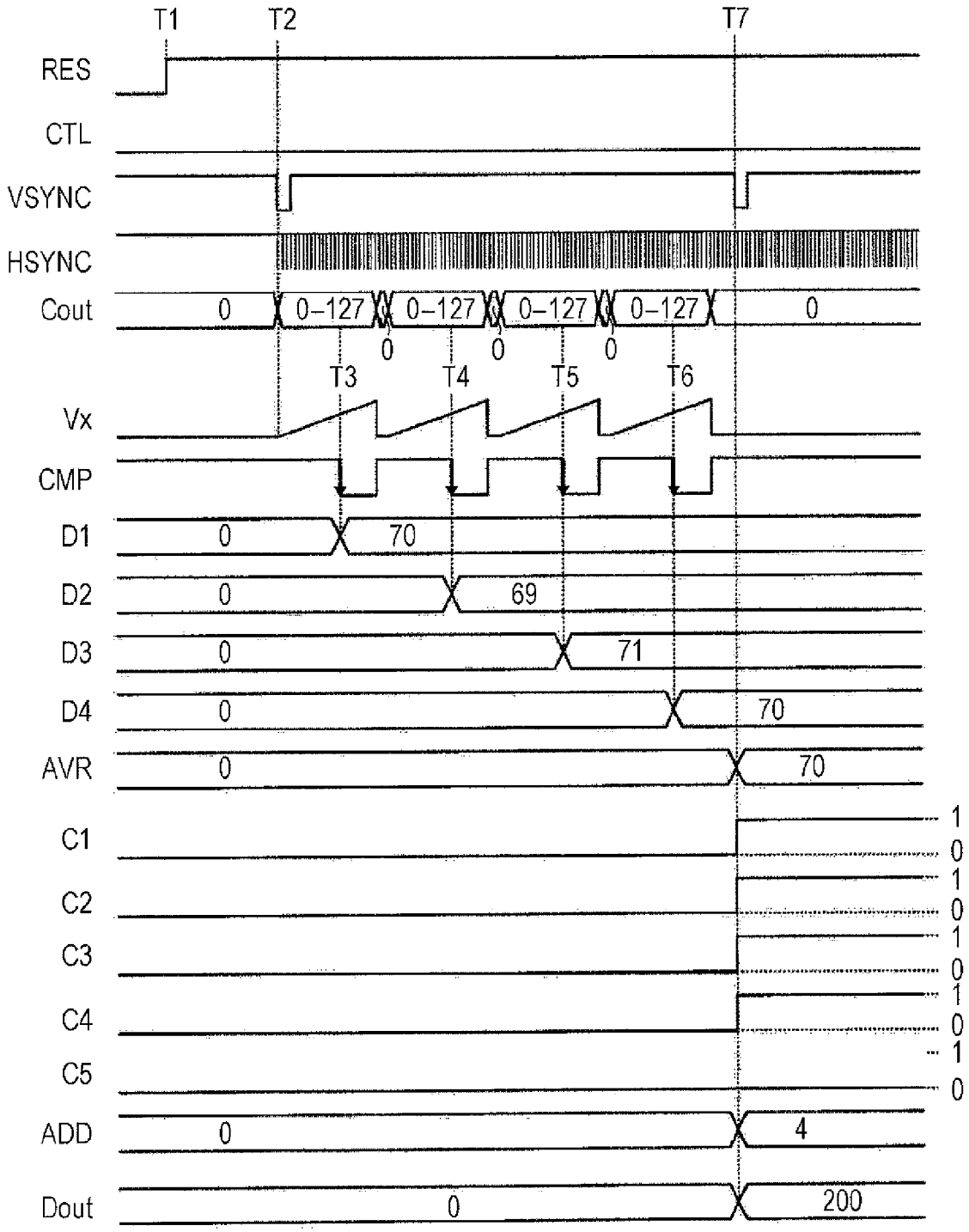
FIG. 7 is a time chart illustrating waveforms of individual portions of a temperature sensing portion according to an embodiment of the invention.

FIG. 7 is a timing chart illustrating operation during a period immediately after the power-on of the electro-optic device 100. After the power-on of the electro-optic device 100, the reset signal RES transits from L-level to H-level at a timing point T1. At this timing point, the lighting control signal CTL is in the L-level state and indicates that image display operation is not to be performed. The temperature sensing portion 34 starts the measurement of temperature from a timing point when the reset signal transits from L-level to H-level, that is, when the initialization has been completed.

When the vertical synchronization signal VSYNC transits to L-level at a timing point T2, the counter 340 starts counting of a falling edge or a rising edge of the horizontal synchronization signal HSYNC. Subsequent thereto, a data value of the piece of count data Cout gradually becomes larger. When the value of the piece of count data Cout reaches "127", the counter 340 resets the count value. Further, the counter 340 carries out the counting four times during one of the vertical scanning periods. As a result, the count signal Vx resulting from performing DA conversion of the piece of count data Cout forms a triangular wave shape.

The comparator 346 compares the count signal Vx with the temperature signal Vtmp, and outputs the output signal CMP. In this example, at each of the timing points T3, T4, T5 and T6, the count signal Vx is larger than the temperature signal Vtmp, and the output signal CMP of the comparator 346 falls down. At this time, each of the pieces of count data Cout is read into a corresponding one of the first to fourth registers 351 to 354. In this example, the piece of temperature data D1 becomes "70" as the result of reading the piece of count data Cout into the first register 351 at the timing point T3; the piece of temperature data D2 becomes "69" as the result of reading the piece of count data Cout into the second register 352 at the timing point T4; the piece of temperature data D3 becomes "71" as the result of reading the piece of count data Cout into the third register 353 at the timing point T5; and the piece of temperature data D4 becomes "70" as the result of reading the piece of count data Cout into the fourth register 354 at the timing point T6.

Moreover, when the vertical synchronization signal becomes L-level at a timing point T7, the average value calculation circuit 360 calculates an average value of the pieces of temperature data D1 to D4 which are the results of the four measurements, and outputs the piece of average temperature data AVR whose data value is "70". Through performing calculation of the piece of average temperature data AVR in such a way as described above, it is possible to specify an accurate temperature. In particular, the formation of the band gap reference circuit 342 and peripheral circuits for driving the pixel circuits P (i.e., the timing control circuit 36, the scanning line driving circuit 22, the driving control circuit 24, the data line driving circuit 26 and the like) on a single-crystalline silicon substrate, just like in this embodiment, is likely to give an adverse influence of noise arising in the peripheral circuits on the band gap reference circuit 342. In such a case, the averaging of the pieces of temperature data D1 to D4 makes it possible to specify a temperature with further accuracy.

Next, each of the comparison circuit 371 to 375 compares a corresponding one of the pieces of temperature range setting data RT1 to RT5 with the piece of average temperature data AVR. In this example, the piece of average temperature data AVR is "70" and, as described above, the pieces of temperature range setting data RT1, RT2, RT3, RT4 and RT5 are "20", "35", "50", "65" and "80", respectively. Thus, at the timing point T7, the pieces of comparison data C1 to C4 each become "1"; while the piece of comparison data C5 becomes "0".

At this time, the addition circuit 380 performs addition of the pieces of comparison result data C1 to C5, and outputs the piece of addition data ADD indicating a resultant data value "4". Further, in the case where the piece of addition data ADD is "4", the selection circuit 382 selects the piece of total light-emitting-line number setting data RN4, so that the total light-emitting-line number specified by the piece of output data Dout becomes "200".

Figure 8:
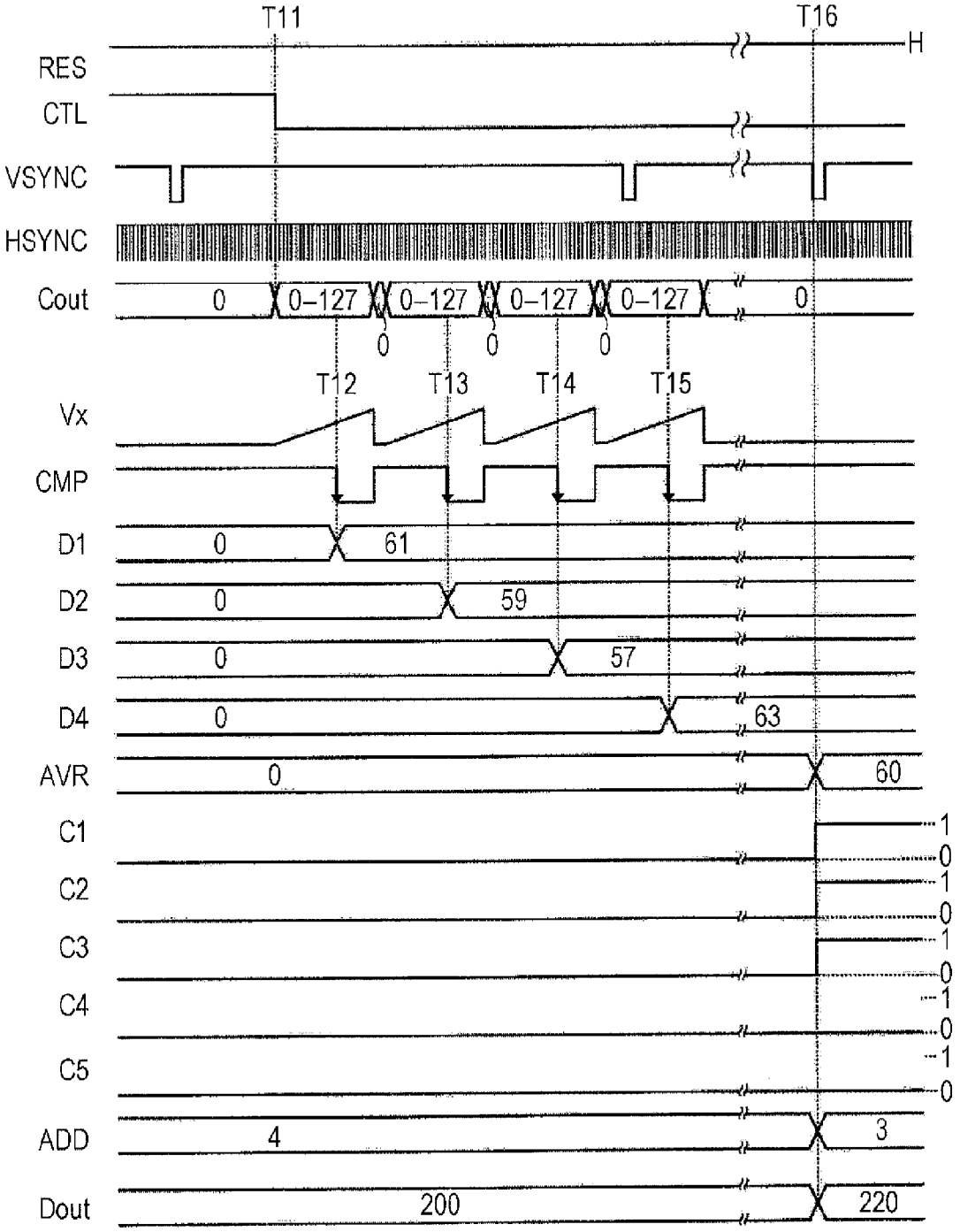
FIG. 8 is a time chart illustrating waveforms of individual portions of a temperature sensing portion according to an embodiment of the invention.

FIG. 8 is a timing chart illustrating operation of the electro-optic device 100 during a period when image display operation is not performed. When the lighting control signal CTL transits from H-level to L-level, that is, moves from a state where image display operation is performed to a state where image display operation is not performed, the temperature sensing portion 34 starts measuring of temperatures. First, the counter 340 starts counting of a falling edge or a rising edge of the horizontal synchronization signal HSYNC. When the value of the piece of count data Cout reaches "127", the counter 340 resets the count value, and starts counting again after elapse of a certain period of time. The counter 340 repeats the counting operation four times.

The comparator 346 compares the count signal Vx with the temperature signal Vtmp and outputs the output signal CMP. In this example, at each of timing points T12, T13, T14 and T15, the value of the count signal Vx becomes larger than that of the temperature signal Vtmp, so that the output signal CMP of the comparator 346 falls down. In this example, the piece of temperature data D1 becomes "61" as the result of reading the piece of count data Cout into the first register 351 at the timing point T12; the piece of temperature data D2 becomes "59" as the result of reading the piece of count data Cout into the second register 352 at the timing point T13; the piece of temperature data D3 becomes "57" as the result of reading the piece of count data Cout into the third register 353 at the timing point T14; and the piece of temperature data D4 becomes "63" as the result of reading the piece of count data Cout into the fourth register 354 at the timing point T15.

Moreover, after the completion of four measurements, at a timing point T16 when the vertical synchronization signal VSYNC becomes L-level first, the average value calculation circuit 360 calculates an average value of the pieces temperature data D1 to D4 which are the results of the four measurements, and outputs the piece of average temperature data AVR whose data value becomes "60". Each of the comparison circuits 371 to 375 compares the piece of average temperature data AVR with a corresponding one of the pieces temperature range setting data RT1 to RT5, and generates the pieces of comparison result data C1 to C3 whose data values each become "1", as well as the pieces of comparison result data C4 and C5 whose data values each become "0".

The addition circuit 380 performs addition of the pieces of comparison result data C1 to C5, so that the value of the addition data ADD becomes "3". Thus, the selection circuit 382 selects the piece of total light-emitting-line number data RN3. As a result, the total light-emitting-line number specified by the output data Dout becomes "220". The timing control circuit 36 generates the start pulse SP2 so that the duration of the start pulse SP2 becomes equal to the length of the light emitting period HDR, which is equivalent to the total light-emitting-line number specified by the piece of output data Dout.

As described above, according to this embodiment, the piece of output data Pout is generated on the basis of temperatures which are measured during the first period when image display operation is not performed, and during the second period when image display operation is performed, the luminance of the electro-optic elements E is controlled on the basis of the generated piece of output data Dout. That is, during the second period when image display operation is performed, the luminance of the electro-optic elements E is controlled on the basis of temperatures which are measured during the first period when image display operation is not performed, which is immediately anterior to the relevant second period, and thus, even when the temperature varies while images are displayed, the luminance of the images does not vary, so that it is possible to suppress the occurrence of the flickering of the images.

Particularly, in this embodiment, the total light-emitting-line number is controlled on a basis of six stages. In such a case where the luminance of the electro-optic elements is corrected on a basis of some stages, any switching of the total light-emitting-line number during the second period when image display operation is performed results in the occurrence of flickering of images on a display screen. In this embodiment, the total light-emitting-line number during the second period is made constant, and thus, the occurrence of flickering of images on a display screen can be suppressed.

B: Modification Example various modifications can be made on the aforementioned embodiment. Specific embodiments of such modifications will be exemplified below. In addition, any ones of embodiments described below may be appropriately combined.

Modification Example 1

Although, in the aforementioned embodiment, there is exemplified the configuration in which the driving control transistor TEL is caused in the conductive state simultaneously with the start of the writing period H, the timing point of causing the driving control transistor TEL to be in the conductive state (i.e., the timing point of setting the driving control signal Z [i] to H-level) can be appropriately changed to a different timing point. For example, the driving control transistor TEL may be caused in the conductive state from a timing point before or after the start of the writing period H. Further, the driving control transistor TEL may be caused in the conductive state from a timing point of the completion of the writing period H. Moreover, the light emitting period HDR may be started at a timing point after elapse of a given period of time from the completion of the writing period H, and may be terminated at a timing point immediately before a next writing period H.

Modification Example 2

Figure 9:
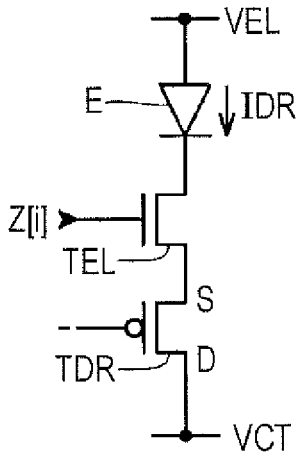
FIG. 9 is a circuit diagram illustrating part of a pixel circuit according to a modification example of an embodiment of the invention.

The conduction type of each of the transistors constituting the pixel circuit P may be appropriately changed. For example, the driving transistor TDR may be a transistor of P-channel type. That is, as exemplified in FIG. 9, it is possible to employ a configuration in which the driving transistor TEL is arranged between the source (S) of such a P-channel type driving transistor TDR and the negative electrode of the electro-optic element E. Further, the driving transistor shown in FIG. 3 may be a transistor of P-channel type.

Modification Example 3

The organic light emitting diode element is just an exemplification of the electro-optic element. The electro-optic element applied to the invention may be any type of electro-optic element, provided that the electro-optic element is an element of self light-emitting type which emits light by itself. For example, an organic EL element, a light emitting diode (LED) element or the like corresponds thereto.

Modification Example 4

Although, in the aforementioned embodiment, the temperature sensing portion 34 generates the piece of output data Dout once during the period when image display operation is not performed, the invention is not limited to this configuration. That is, configuration may be made such that the temperature sensing portion 34 periodically generates the piece of output data Dout during the first period when image display operation is not performed, and in order to control the luminance of the electro-optic elements E, the scanning line driving circuit 22, the driving control circuit 24, the data line driving circuit 26 and the timing control circuit 36 performs setting of the length of the light emitting period HDR on the basis of the piece of output data Dout which is generated last during the first period when image display operation is not performed. In the case where the length of a period when image display operation is not performed is long, a temperature at a timing point when image display operation is started varies from a temperature at a timing point when the piece of output data Dout was generated, so that an accurate correction is likely to be difficult to be made. According to this modification example, the piece of output data Dout is periodically generated and the luminance of the electro-optic elements E is corrected on the basis of the piece of output data Dout which is generated last, and thus, it is possible to correct the variation of the luminance due to the variation of temperature with further accuracy.

Modification Example 5

Although, in the aforementioned embodiment, the light emitting period HDR is corrected by paying attention to the electric-current characteristic of the driving transistor TDR, the target of the correction may be image data which specifies grayscale levels of images to be displayed, or the levels of the data signals. The point is that any object capable of controlling the luminance of the electro-optic elements E can be a target of the correction. Further, the correction may be made in view of not only the temperature characteristic of the driving transistor TDR but also the temperature characteristic of the electro-optic element E as an electro-optic element.

C: Application Example

Figure 10:
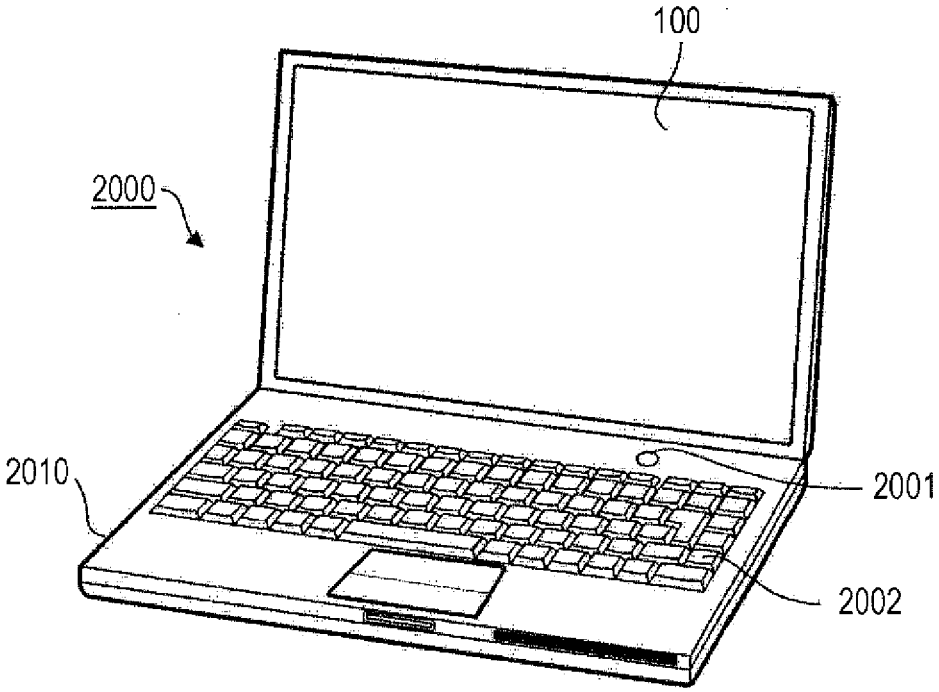
FIG. 10 is a perspective view illustrating an external view of a personal computer which is an example of an electronic device according to an aspect of the invention.
Figure 11:
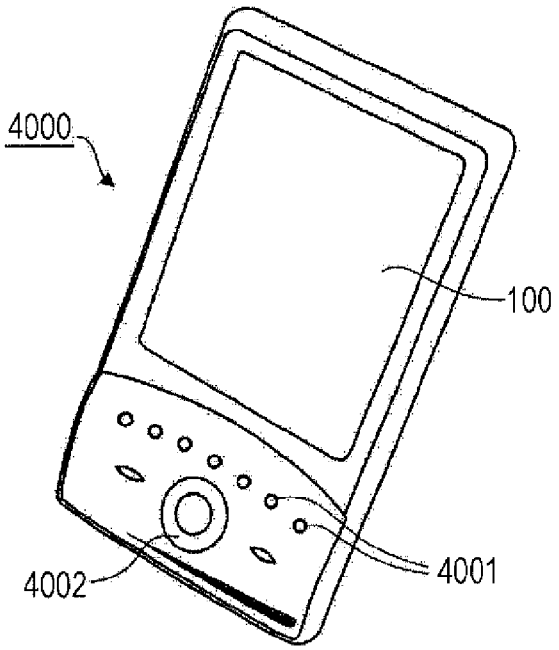
FIG. 11 is a perspective view illustrating an external view of a mobile telephone device which is an example of an electronic device according to an aspect of the invention.
Figure 12:
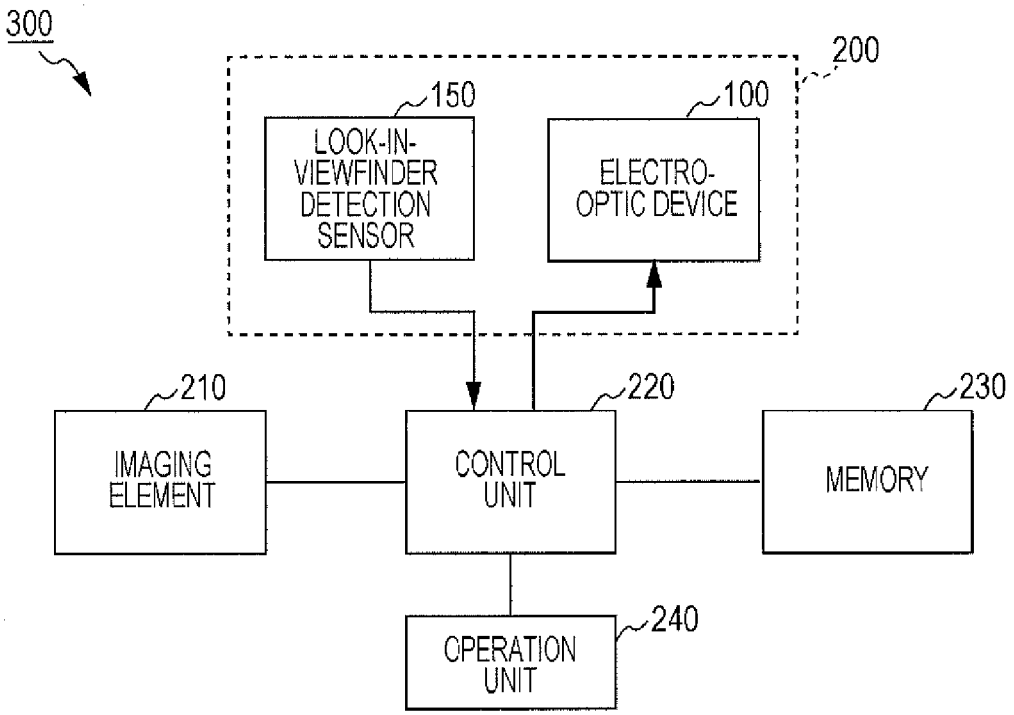
FIG. 12 is a block diagram illustrating an example of a still camera which is an example of an electronic device according to an aspect of the invention.

Next, electronic devices to which the electro-photonic device according to some aspects of the invention is applied will be described. In FIGS. 10 to 12, embodiments of electronic devices each employing the electro-optic device 100 according to any one of the embodiments having been described above are illustrated.

FIG. 10 is a perspective view illustrating a configuration of a mobile type personal computer employing the electro-optic device 100. A personal computer 2000 includes the electro-optic device 100 which displays various images, and a main unit 2010 which is provided with a power switch 2001 and a keyboard 2002. The electro-optic device 100 employs organic light emitting diode elements as the electro-optic elements E, and thus, is capable of displaying an easy-to-view screen having a broad view angle. The personal computer 2000 is configured such that an image display face of the electro-optic device 100 can be folded toward the face of the keyboard. Further, a lighting control signal CTL which becomes L-level in the folded state and becomes H-level in the unfolded state is supplied to the electro-optic device 100 from a main unit of the personal computer 2000.

FIG. 11 is a perspective view illustrating a configuration of a mobile telephone device to which the electro-optic device 100 is applied. A mobile telephone device 4000 includes a plurality of operation buttons 4001, a power switch 4002, and the electro-optic device 100 which displays various images.

When the power switch 4002 is turned on, various files of information, such as an addresses book or a schedule book, are displayed on the electro-optic device 100. The mobile telephone device 4000 moves to a state where image display operation is not performed in order to save power consumption after having displayed an image during a certain period of time. A lighting control signal CTL which becomes H-level during a period when image display operation is performed and becomes L-level during a period when image display operation is not performed is supplied to the electro-optic device 100 from a main unit of the mobile telephone device 4000.

FIG. 12 is a block diagram of a digital still camera 300 to which the electro-optic device 100 is applied. The digital still camera 300 includes an electronic viewfinder 200, an imaging element 210, a control unit 220, a memory 230 and an operation unit 240. The operation unit 240 includes a shutter button and setting buttons for use in various settings. The imaging element 210 images an object under the control of the control unit 220, and outputs image data related to the object to the control unit 220. The control unit 220 is constituted by a CPU and the like, and performs control of the whole of the digital still camera 300. The memory 230 is constituted by flash memory chips or the like, and stores therein the image data. The electronic viewfinder 200 includes the aforementioned electro-optic device 100 and a look-in-viewfinder detection sensor 150. The look-in-viewfinder detection sensor 150 includes, for example, a light emitting portion for infrared light and a light receiving portion for infrared light. When a person looks in the electronic viewfinder 200, infrared light emitted from the light emitting portion is reflected and is received by the light receiving portion. In this case, the look-in-viewfinder detection sensor 150 outputs a detection signal equivalent to an amount of light received by the light receiving portion. The control unit 220 specifies an event in which the person looks in the electronic viewfinder 200 by comparing the value of the detection signal with a threshold value. Further, the control unit 220 outputs a lighting control signal CTL, which indicates H-level during a period when the person looks in the electronic viewfinder 200 and indicates L-level during a period except the above period, to the electro-optic device 100.

Through this configuration, the electronic viewfinder 200 displays an image during only a period when a person looks therein, and does not display any image during a period except the above period. Further, the electronic viewfinder 200 detects temperatures during the period when image display operation is not performed, and corrects the luminance of light which is kept constant during the period when image display operation is performed, on the basis of the detected temperatures, and thus, it is possible to suppress the occurrence of flickering of images on a display screen thereof. In addition, the measurement of temperature may be performed during any one of periods which are, for example, a period during which settings for photographing, such as a shutter speed, an F value and a white balance, are performed; a period during which a photographing person makes direction while using the operation unit 240 provided with buttons, a dial, a touch panel and the like; and a period during which a single-lens reflex mirror is moving in conjunction with a shutter operation. Further, the measurement of temperature may be performed at timing when a focus adjustment of an autofocusing lens is started, and the like. Moreover, in the case where a display panel for displaying the result of photographing is provided thereon, the measurement of temperature may be performed during a period when images are displayed on the display panel.

Well-known electronic devices to which the electro-optic device according to some aspects of the invention is applied includes, besides the devices exemplified in FIGS. 10 to 12, a television set, a video camera, a car navigation device, a pager, an electronic diagram, electronic paper, an electronic calculator, a word processor, a work station, a video telephone, a POS terminal, a printer, a scanner, a copying machine, a video player, a touch panel and the like.

The entire disclosure of Japanese Patent Application No. 2013-027615, filed Feb. 15, 2013 is expressly incorporated by reference herein.

What is claimed is:

1. An electro-optic device comprising:

a single-crystalline silicon substrate;

a pixel circuit formed on the single-crystalline silicon substrate, the pixel circuit including an electro-optic element and a driving transistor which supplies an electric current to the electro-optic element;

a first data generator formed on the single-crystalline silicon substrate, the first data generator, during a first period when image display operation is not performed, detecting a temperature and generating first data which allows control of brightness of an image in accordance with the detected temperature, the first data generator including:

a temperature detector which detects the temperature and outputs, for each of a plurality of detections, count data at times when a voltage of a temperature signal and a voltage of a count signal are equal to each other, as one of a plurality of pieces of temperature data which indicate the temperature, the temperature detector including:

a temperature detection circuit that outputs, for each of the plurality of detections, the temperature signal having the voltage indicating the temperature;

a counter that counts, for each of the plurality of detections, one of falling edges and rising edges of a horizontal synchronization signal and outputs resultant count data; and a digital to analog conversion circuit that, for each of the plurality of detections, performs digital to analog conversion of the count data and outputs the resultant count signal; and an average temperature calculator which calculates an average value of temperatures obtained by causing the temperature detector to perform the plurality of detections and calculating an average value of the plurality of pieces of temperature data, and generates the first data on a basis of the average value; and a luminance controller formed on the single-crystalline silicon substrate, the luminance controller, during a second period when image display operation is performed, controlling luminance of the electro-optic element in accordance with the first data.

2. The electro-optic device according to claim 1, wherein the first data specifies, for each of a plurality of vertical synchronization periods, a light emitting period during which the electric current is supplied to the electro-optic element.

3. The electro-optic device according to claim 1, wherein the first data generator starts the detection of temperature from at least one timing point of a transition from the second period to the first period.

4. The electro-optic device according to claim 1, wherein the first data generator periodically generates the pieces of first data during the first period, and the luminance controller performs control of the luminance of the electro-optic element on a basis of a last piece of first data which is generated last during the first period.

5. An electronic device comprising:

the electro-optic device according to claim 1; and a processor configured to supply the electro-optic device with a lighting control signal which specifies any one of the first period and the second period.

6. An electronic device comprising:

the electro-optic device according to claim 2; and a processor configured to supply the electro-optic device with a lighting control signal which specifies any one of the first period and the second period.

7. An electronic device comprising:

the electro-optic device according to claim 3; and a processor configured to supply the electro-optic device with a lighting control signal which specifies any one of the first period and the second period.

8. An electronic device comprising:

the electro-optic device according to claim 4; and a processor configured to supply the electro-optic device with a lighting control signal which specifies any one of the first period and the second period.

9. An electronic device comprising:

a viewfinder that includes the electro-optic device according to claim 1 and a detector which detects an event when a user looks in the viewfinder; and a processor configured to generate a lighting control signal on a basis of a result of detection made by the detector, and supply the generated lighting control signal to the electro-optic device, the lighting control signal, specifying one of the first period and the second period.

10. An electronic device comprising:

a viewfinder that includes the electro-optic device according to claim 2 and a detector which detects an event when a user looks in the viewfinder; and a processor configured to generate a lighting control signal on a basis of a result of detection made by the detector, and supply the generated lighting control signal to the electro-optic device, the lighting control signal specifying one of the first period and the second period.

11. An electronic device comprising:

a viewfinder that includes the electro-optic device according to claim 3 and a detector which detects an event when a user looks in the viewfinder; and a processor configured to generate a lighting control signal on a basis of a result of detection made by the detector, and supply the generated lighting control signal to the electro-optic device, the lighting control signal specifying one of the first period and the second period.

* * * * *